US005261168A

United States Patent [19]

Li

[11] Patent Number: 5,261,168

[45] Date of Patent: Nov. 16, 1993

[54] FRUIT DRYER

[76] Inventor: Kuan-Hsien Li, No. 20, Nung 132, Lane 51, Yung-Ta Road, Yung-Kang Hsiang, Tainan Hsien, Taiwan

[21] Appl. No.: 46,576

[22] Filed: Apr. 16, 1993

[51] Int. Cl.[5] ..... F26B 25/18

[52] U.S. Cl. ..... 34/197; 34/184; 34/187

[58] Field of Search ..... 34/195, 196, 197, 184, 34/211, 238, 187; 426/418, 496; 219/400

[56] References Cited

U.S. PATENT DOCUMENTS 1,927,396 9/1933 Freund et al. ..... 34/187
4,190,965 4/1980 Erickson ..... 34/196
4,380,127 4/1983 Roberts ..... 34/197
5,215,775 6/1993 Hoffman, Jr. ..... 34/195

*Primary Examiner*—Henry A. Bennet
*Attorney, Agent, or Firm*—Morton J. Rosenberg; David I. Klein

[57] ABSTRACT

A fruit dryer includes a base to cintain a hot wind unit to produce hot wind, a bottom case and a plurality of intermediate cases possible to be deposited one on another for placing fruit to be dried therein, and an upper cap. The bottom case is deposited on the base. The intermediate cases is raised up for use or is lowered down for non-use relative to each other to lower the whole height of the fruit dryer for packing, transporting or storing.

2 Claims, 7 Drawing Sheets

FRUIT DRYER

BACKGROUND OF THE INVENTION

A conventional fruit dryer shown in FIG. 10 includes a round base 10, a plurality of drying cases 20, and an upper cap 30 and a heater tube in the base 10 combined together.

However, this conventional fruit dryer has disadvantages as follows.

1. Drying cases are put one on another, becoming very high and inconvenient for packing and transportation and storing.

2. The heater tube has no protective structures, so if the drying case are taken off, then the heater tube exposes out, burning a hand in case of power on if touching it.

3. Transporting charges for it is expensive because of its large dimensions.

4. Its heating process mainly depends on natural heat rising from the heater tube fixed on a bottom of the base, its drying effect not good nor pervading to every corner.

SUMMARY OF THE INVENTION

This invention has been devised to improve the conventional fruit dryer, planned to have features as follows.

1. A plurality of intermediate cases for placing fruit to be dried thereon are provided to be deposited on each other, the height of each one in use can be lowered down to nearly half the height in use when not in use.

2. A bottom case has a net-shaped bottom to cover a heater in a base after they are combined together, preventing the heater from being touched by a hand.

3. The bottom case is assembled with the base, sinking a little in the base to save dimensions, saving some cost for a protective cap on the heater.

4. Each intermediate case can be combined together, deposited one on another, by means of an elongate curved plate fitting between two - one inner and the other outer - annular vertical walls, and an upper case can be raised up by rotating relative to a lower case in use and lowered down rotating back in storing.

5. The height of each intermediate case can be raised up or lowered down by holding the base firmly and rotating the upper cap at the same time so that the whole height of the fruit dryer may be lowered as short as possible for storing or packing.

6. It is easy to raise up or lower down each intermediate case without necessity of moving each of them, only by moving the upper cap.

7. Its dimensions can be saved in lowering down as little as possible, advantageous for packing and transporting.

8. A motor and a fan is additionally provided to quicken flow of heated air up around the interior of the dryer body.

BRIEF DESCRIPTION OF DRAWINGS

The invention will be better understood by reference to the accompanying drawings, wherein.

DESCRIPTION OF THE PREFERRED EMBODIMENTS

Figure 1:
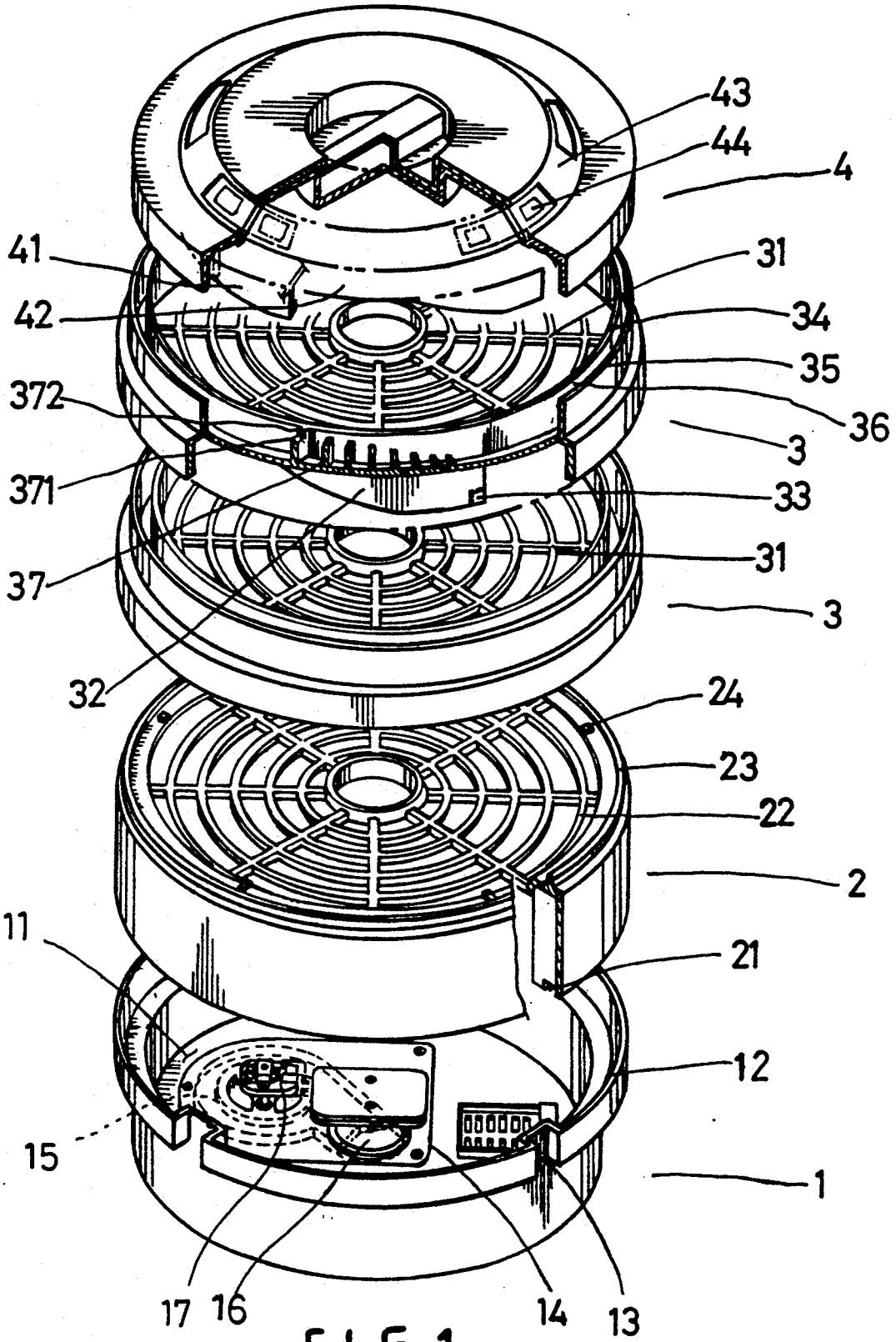
FIG. 1 is an exploded perspective view of a fruit dryer in the present invention.
Figure 2:
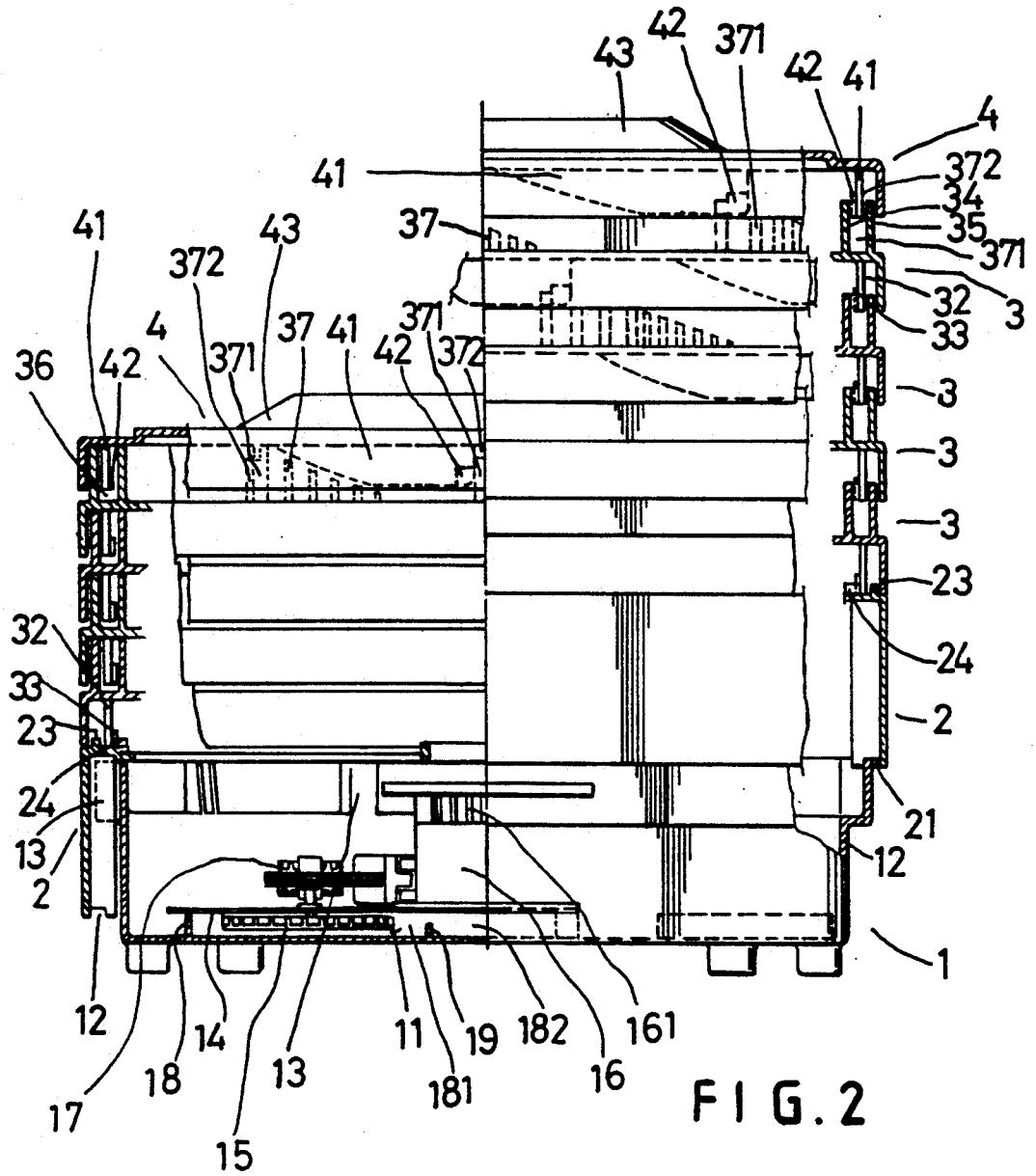
FIG. 2 is a side cross-sectional view of the fruit dryer in the present invention.

A fruit dryer in the present invention, as shown in FIGS. 1, and 2 includes a base 1, a bottom case 2, a plurality of intermediate cases 3, and an upper cap 4 and a hot wind unit 11 as main components.

The base 1 is shaped round and having an annular vertical wall, a flange on the upper edge 12 of the annular wall, and several diametrically inward grooves 13. The hot wind unit 11 is mounted on a bottom wall of the base 1.

The bottom case 2 is shaped also round, having an annular vertical wall, a plurality of a pair of vertical radially parallel walls 21 a notch 211 at bottom, a net-shaped frame 22 at a top for placing fruits to be dried, and an annular projection 23 on top of the annular vertical wall 21, a plurality of stop projections 24 spaced around on an outer edge of the net-shaped frame 22. The notches 211 slide on the upper edge 12 and the pair of vertical walls 21 engage the inward grooves 13 of the base 1.

The plurality of intermediate cases 3 respectively have a net-shaped frame 31 for placing fruit to be dried, a plurality of elongate sloped curved plates 32 respectively having a sloped down bottom surface, a projection 33 on a proper place on each elongate sloped curved plate 32, an inner and an outer annular vertical wall 34 35, an annular gap 36 formed between the inner and the outer annular vertical walls 34, 35, a plurality of groups of upright plates 37 provided spaced apart in the annular gap 36 on its bottom and located in corresponding to the elongate sloped curved plates 32. Each upright plate 37 of each group has different height to make up a down slope from the left to the right and the leftmost upright plate 371 is flush with the inner and the outer annular vertical wall 34, 35, having an upper notch 372.

The upper cap 4 is shaped round, having a plurality of elongate sloped curved plates 41 just as those 32 of the intermediate plates 3, and a projection 42 on a proper place on the plate 41, an adjustable cap 43 and a plurality of air holes 44.

Figure 6:
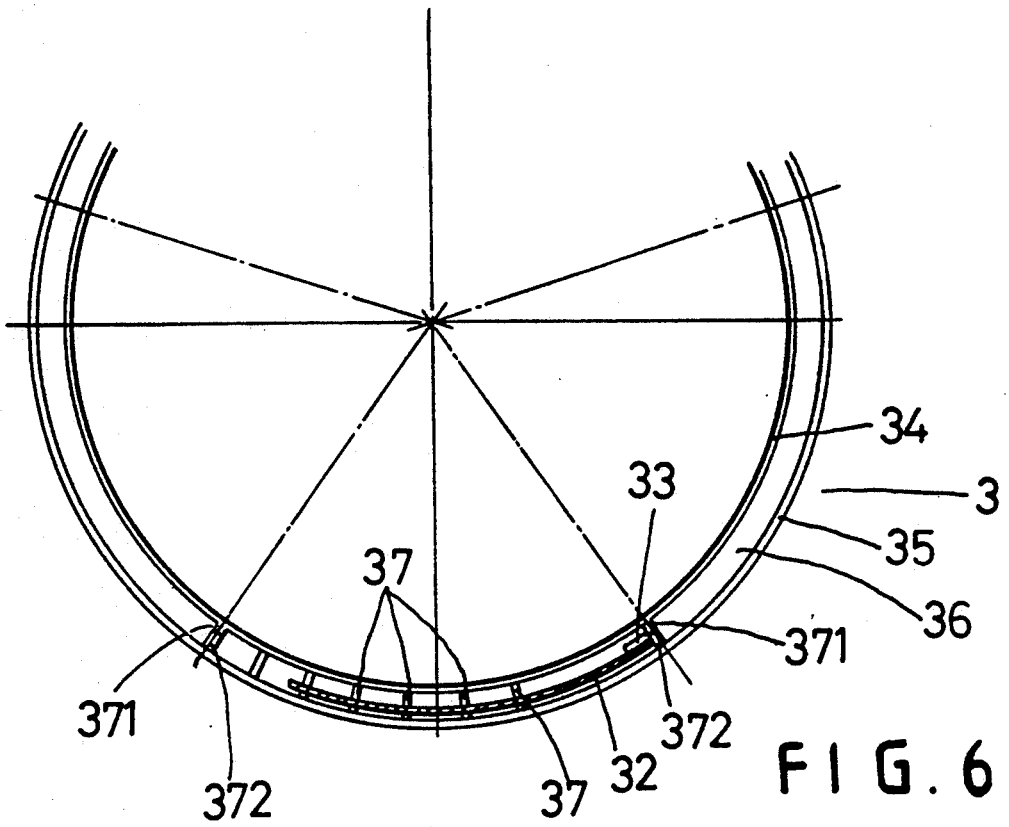
FIG. 6 is an upper view of an elongate sloped curved plate moved to be located on one group of the upright low plates in two intermediate cases combined together in the present invention, showing an upper intermediate case lowered down relative to a lower one.
Figure 7:
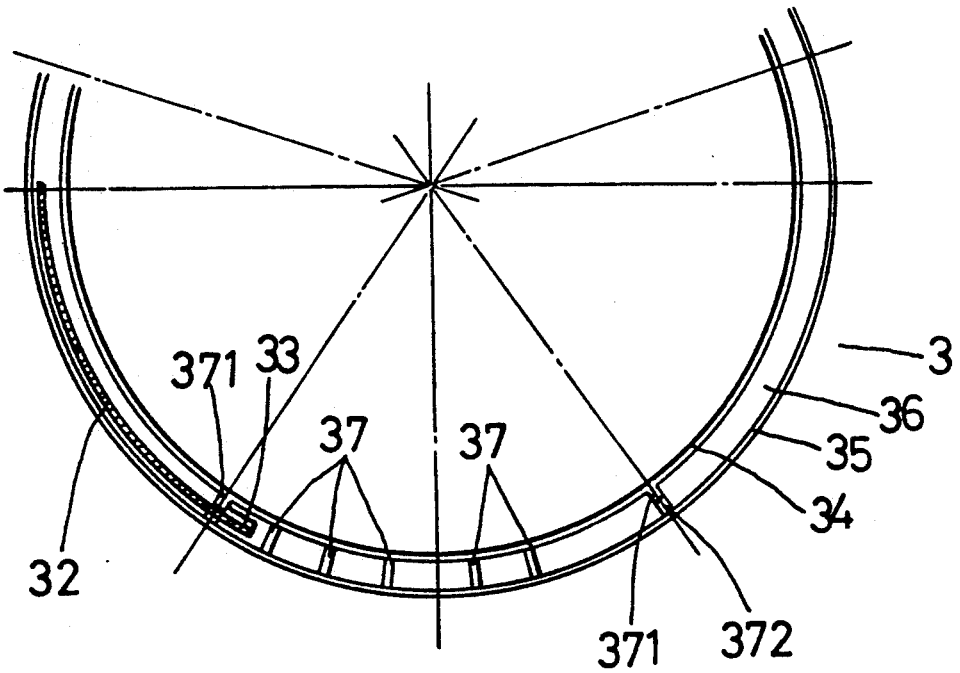
FIG. 7 is another upper ivew of the elongate sloped curved plate moved to be located on another group of the upright low plates in two intermediate cases combined together in the present invention, showing an upper intermediate case raised up relative a lower one.
Figure 8:
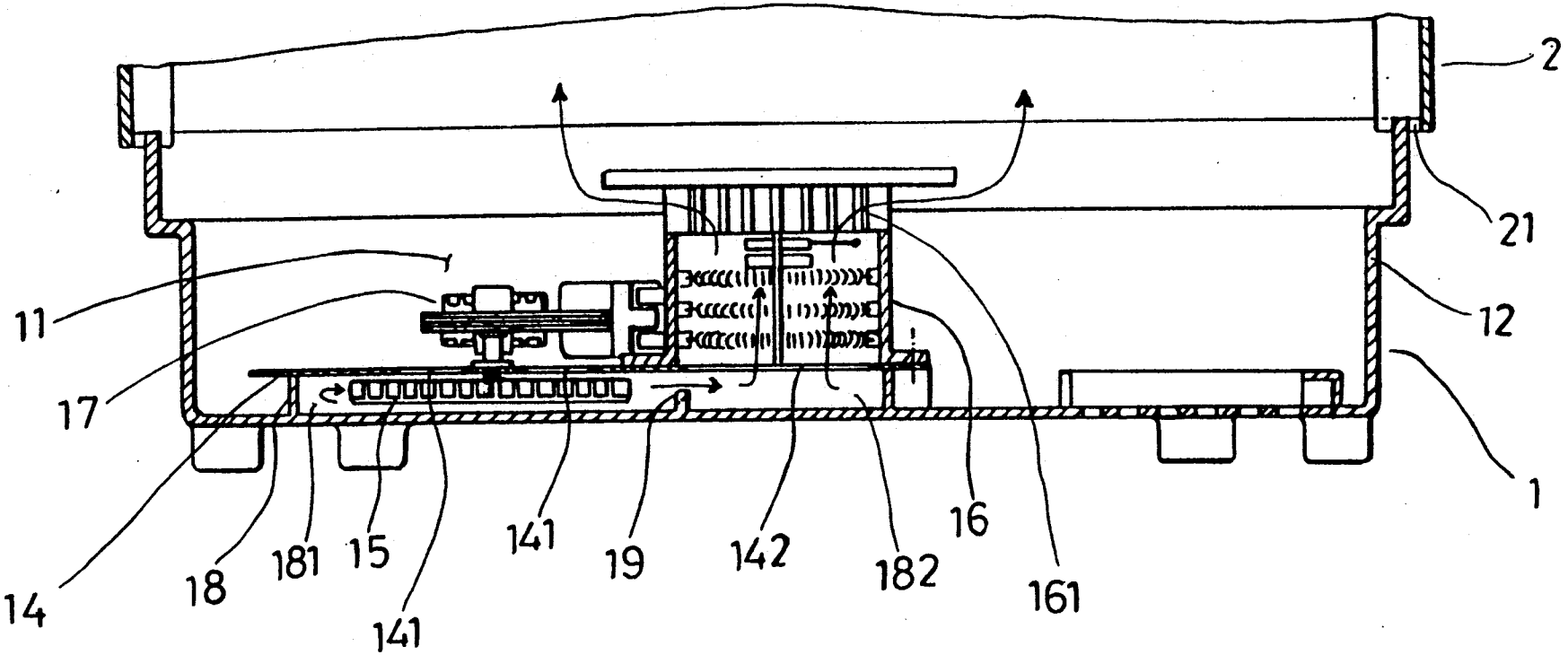
FIG. 8 is a cross-sectional view of a hot wind unit in the present invention.

As shown in FIGS. 6 and 7, 8, the hot air unit 11 is mounted on the bottom of the base 1, having a bottom plate 14 horizontally fixed above the bottom of the base 1, a fan 15 fixed under the bottom plate 14, a heater 16 on the bottom plate 14 and a motor 17 on the bottom plate 14 above the fan 15 to drive the fan.

A wind chamber 18 is formed with the bottom plate 14 of the hot wind unit 11 and the bottom of the base 1 and two separating plates 183, 183 on both sides between the bottom plate 14 and the bottom of the base 1, and then the wind chamber 18 is partitioned into a large chamber 181 and a small chamber 182 with a vertical low plate 19 between the two separating plates 183, 183. The large chamber 181 has an air inlet 141 in the bottom plate 14 and,the small chamber 182 has an air out let 142 in the bottom plate 14 to let the wind coming out of the fan 15 driven by the motor 17 to flow up in the bottom case 2, the intermediate cases 3 and through the upper cap 4. The upper side wall of the heater 16 has a plurality of air outlets 161 for air to go up through.

Figure 3:
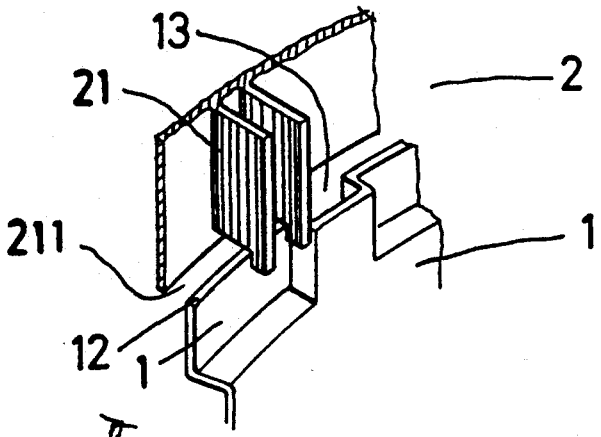
FIG. 3 is a perspective view of a relative position of a base and a bottom case in the fruit dryer in the present invention, showing each two upright walls of a bottom case stopped by each U-shaped groove of the base.
Figure 4:
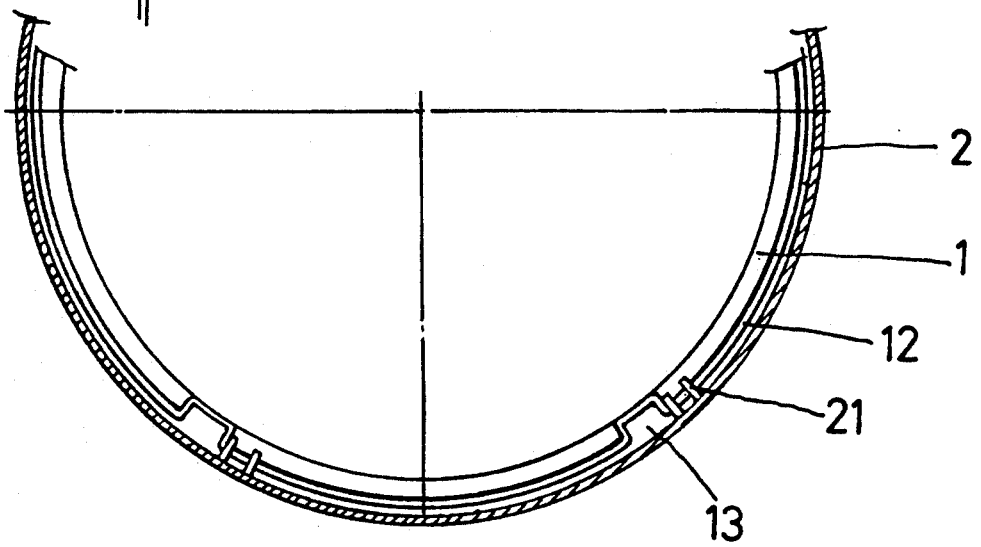
FIG. 4 is an upper view of a relative position of base and a bottom case in the fruit dryer in the present invention, showing each two upright walls of a bottom case stopped by each U-shaped groove of the base.
Figure 5:
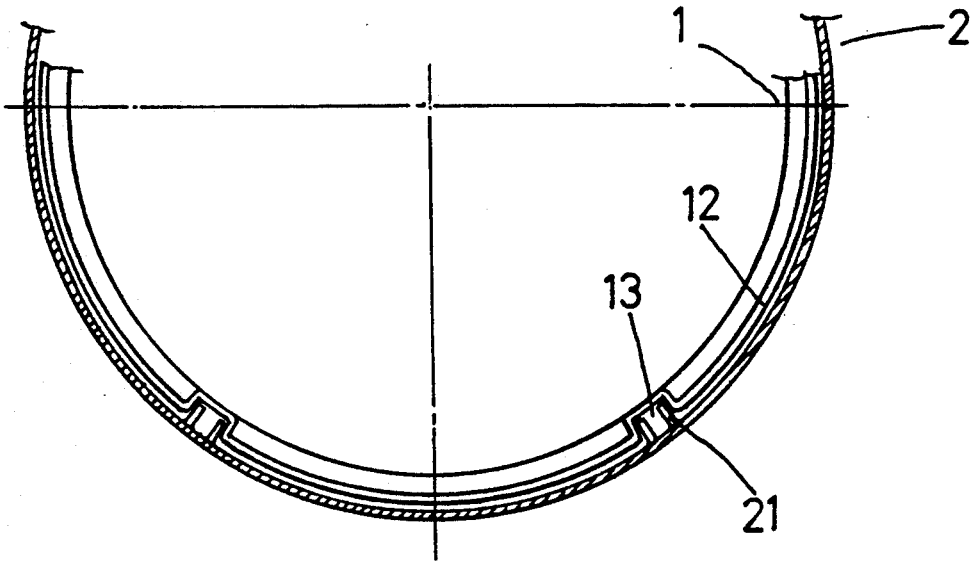
FIG. 5 is another upper view of a relative position of the base and the bottom case in the fruit dryer in the present invention, showing each two right walls of the bottom case engaging each U-shaped groove of the base.

In assembling, as shown in FIGS. 2 and 3, the bottom case 2 is deposited on the base 1, with the pairs of vertical walls 21, 21 lying on the upper circumferential edge 12 and then being moved to slide thereon until the lower edges of the vertical walls 221 are stopped by the edges of the grooves 13. Then the bottom case 2 has to be lifted and rotated a little, letting the vertical walls 21 engages the grooves 13 as shown in FIGS. 3, 4, 5, so that the bottom case 2 wholly sinks partly in the base 1 securely. Then the net-shaped frame 22 of the bottom case 2 is located above the hot wind unit 11 as shown in FIG. 2. One of the intermedoate case 3 is to be deposited on the bottom case 2, with the projections 23 of the bottom 2 preventing the intermediate case 3 from falling off the bottom case 2. Then the intermediate case 3 is rotated until the projection 33 of the elongate sloped curved plate 32 is stopped by a stop projection 24 so as to stop the intermediate case 3, lest the bottom case 2 rotates idle around the base 1 to interfere with the rising of the intermediate case 3. When another intermediate case 3 is to be deposited on a lower one 3, the elongate sloped curved plate 32 of the upper one 3 is inserted in the gap 36 of the lower one 3 and placed on one unit of the upright plates 37, as shown in FIG. 6. Then the-upper intermediate case 3 is rotated and gradually lifted up by the elongate sloped curved plate 32 rising up by sliding on one group of the upright plates 37, until the projection 33 comes to be stopped by the notch 372 of the left-most upright plate 371 so that the upper intermediate case 3 is stopped at that position securely as shown in FIG. 7. The upper cap 4 is deposited securely on the highest intermediate case 3 in the same process as that just described in depositing an upper intermediate case 3 on a lower one 3 .

If the upper cap 4 is rotated reversely with the base 1 held firmly, with the projection 42 of the curved plate 41 of the upper cap 4 leaving the notch 372 and the longate sloped curved plate 32 being moved gradually down along one group of upright plates 37 until the right end vertical surface of the elongate sloped curved plate 41 is stopped by the left-most vertical plate 371. Then the upper cap 4 comes to the lowest position, no longer rotates relative to the highest intermediate case 3. But if the upper cap 4 is rotated continuously relative to the next higher intermediate case 3, it can lower the next higher intermediate case 3 together with the highest one 3 with the cap 4 to the lowest position as just described in lowering the upper cap 4. Then all of the intermediate cases 3 are lowered down in the process as just described, so the whole fruit dryer becomes a minimum size as shown in the right side of FIG. 2, for convenience of packing, transporting or storing.

Figure 9:
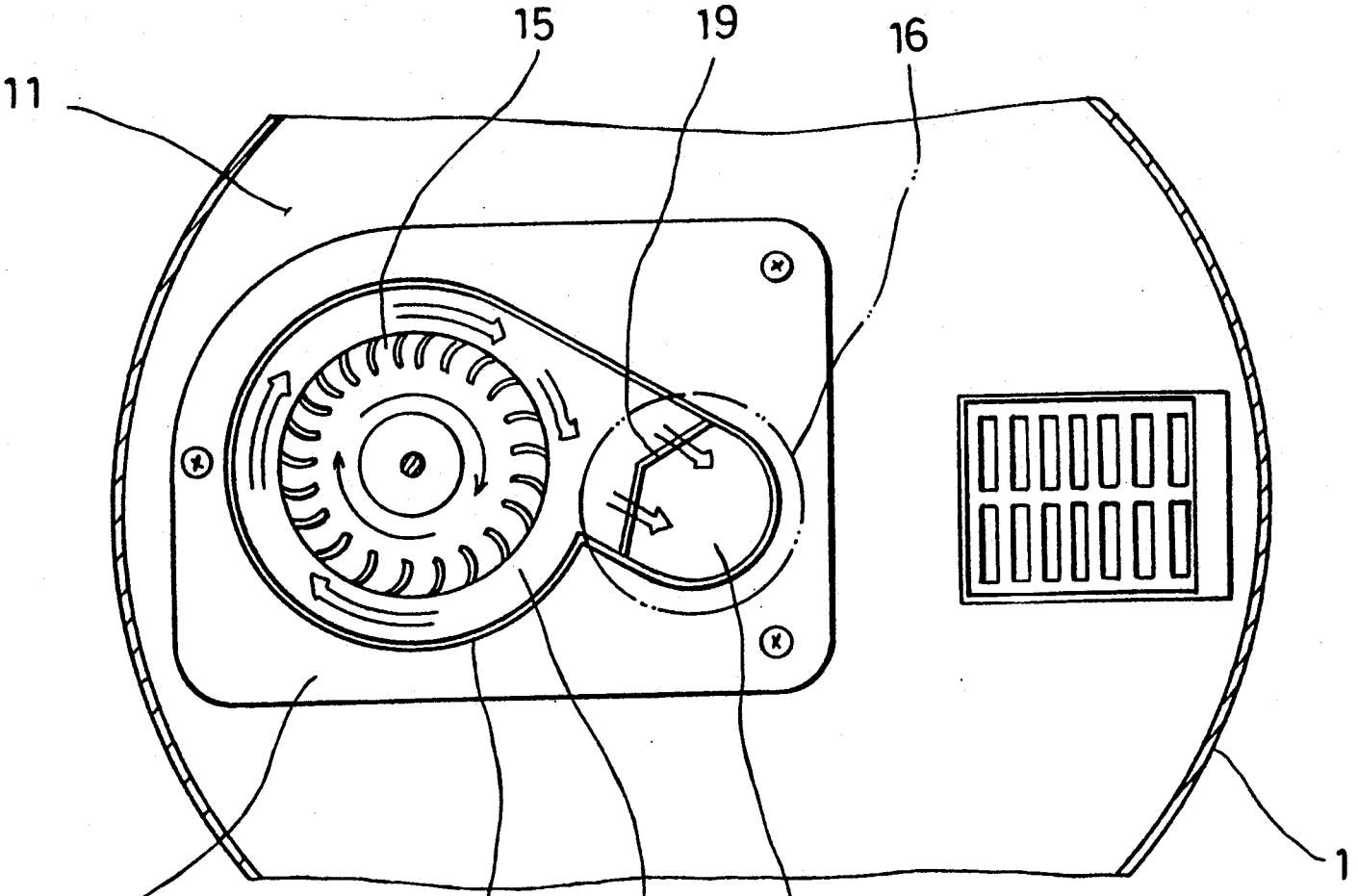
FIG. 9 is an upper view of the hot wind unit in the present invention.
Figure 10:
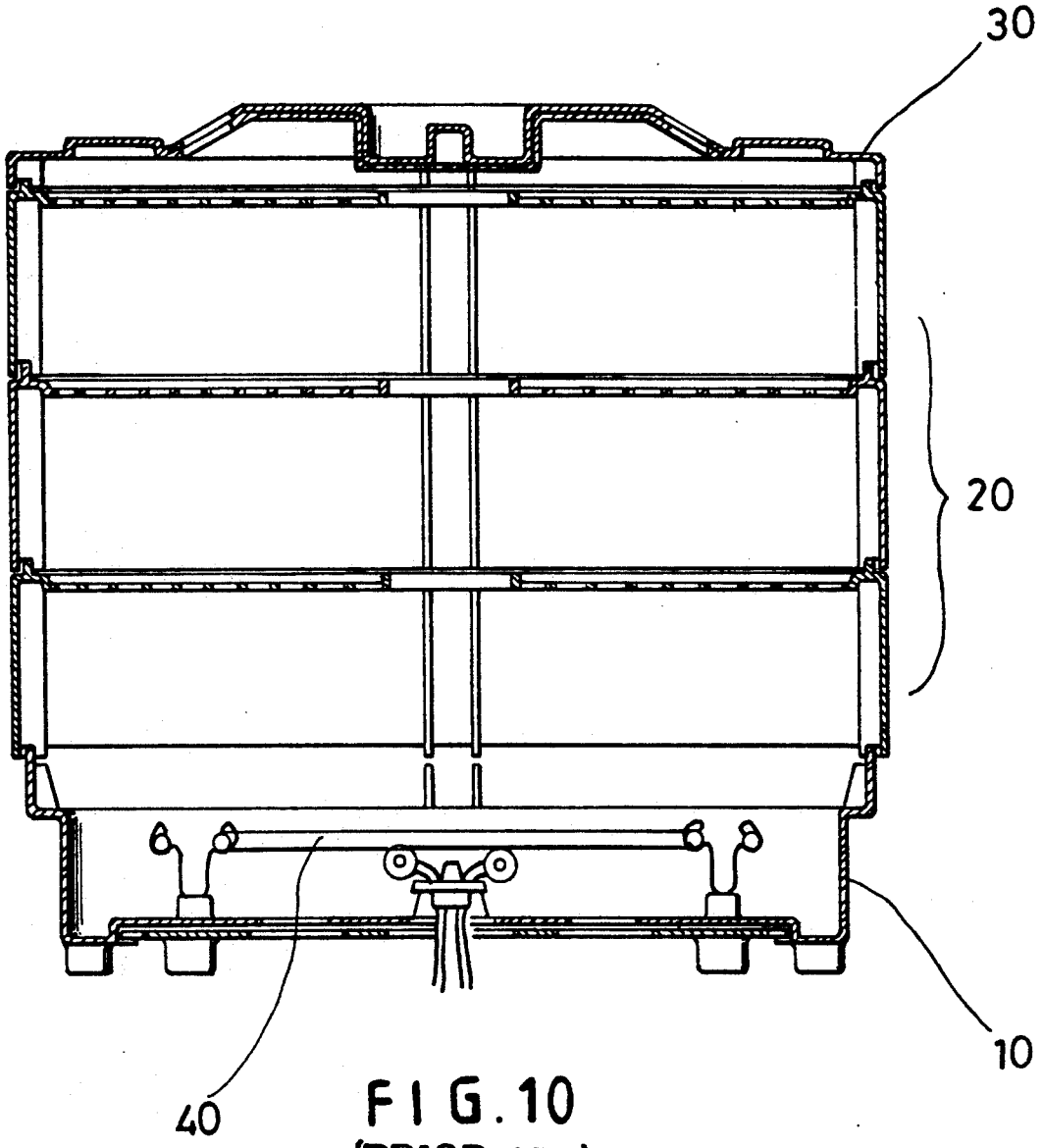
FIG. 10 (PRIOR ART)
FIG. 10 is a side cross-sectional view of a conventional fruit dryer.

As shown in FIGS. 8 and 9, the fan 15 driven by the motor 17 produces cool wind in the large chamber 181, which blows into the small chamber 182 and then passes through the wind outlet 142 of the bottom plate 14 and is heated by the heater 16. Then the heated hot wind is blown up through the air holes 161 in the upper wall of the heater 16, and then through the bottom case 2, each intermediate case 3 and finally through the air holes 44 in the upper cap 4 drying fruit put on the net-shaped frames 22, 31.

While the preferred embodiments of the invention have been described above, it will be recognized and understood that various modifications may be made therein and the appended claims are intended to cover all such modifications which may fall within the spirit and scope of the invention.

What is claimed is:

1. A fruit dryer comprising;

a base shaped round and having an annular vertical wall, a flat bottom, an open top, a top flange and a plurality of U-shaped grooves in said top flange spaced apart and extending inward, and a hot wind unit being mounted on the bottom:

a bottom base to be rotatably deposited in the upper flange of said base, shaped round, and having a vertical circumferential wall, a net-shape horizontal frame for placing fruit to be dried, an annular projection on top of said circumferential wall, a plurality of small stoppers inside said annular projection;

a plurality of intermediate cases respectively shaped round, having a net-shaped horizontal frame for putting fruit to be dried, an outer and an inner annular vertical wall, an annular gap formed between said outer and said inner annular vertical wall, a plurality of elongate sloped curved plates, a plurality of groups of upright low plates equally spaced apart on the bottom of said annular gap, being deposited one on another and the lowest said intermediate case being deposited on said bottom case;

an upper cap shaped round, having an adjusting cap, many air holes, a plurality of elongate sloped curved plates with a sloped bottom surface, and a projection on each elongate sloped curved plate; and, said U-shaped grooves of said base engaging said pairs of vertical walls of said bottom case for said bottom case to sins a little in and combined with said base, each said intermediate case having a projection on the right end of each said elongate curved plate to be stopped by one of said stoppers of said bottom case when the lowest said intermediate case is rotated relative to said bottom case, each said group of said upright low plates of each said intermediate case corresponding to each said elongate curved plate and having gradually higher height from the right one to the left one, the left-most said upright low plate having a notch on top for said projection of said elongate curved plate to engage for stopping said elongate sloped curved plate at that position when said intermediate case is rotated, each said elongate sloped curved plate and each projection on each said elongate sloped curved plate of said upper cap fitting in said annular gap of the highest intermediate case, said upper cap being gradually raised up for a certain height relative to the said highest intermediate case when rotated, said intermediate case in order being gradually raised up for a certain height relative to the lowest said intermediate one.

2. The fruit dryer as claimed in claim 1, wherein said hot wind unit is provided in said base, having a wind chamber formed on the bottom of said base, partitioned with an upper horizontal plate and two vertical side plates, said wind chamber partitioned into a large chamber in the left side and a small chamber in the right side divided by a partition plate, an air inlet in said upper horizontal plate communicating with said large chamber, a fan in said large chamber under said air inlet, a motor fixed on said horizontal plate to drive said fan, said large chamber located under said air inlet, an air outlet in said horizontal plate communicating with said small chamber, a heater fixed on said horizontal plate above said air outlet, many air holes in an upper wall of said heater communicating with the interior of said bottom case, said fan driven by said motor producing wind to blow from said large chamber to said small chamber and to go up through said wind air outlet to be heated by said heater, said heated hot wind passing through said intermediate cases and finally reaching said upper cap to escape out of said many air holes in said cap.

* * * * *